US010006690B2

(12) United States Patent
Nagata et al.

(10) Patent No.: US 10,006,690 B2
(45) Date of Patent: Jun. 26, 2018

(54) AIR CONDITIONER AND METHOD FOR CONTROLLING THE AIR CONDITIONER

(75) Inventors: Itaru Nagata, Osaka (JP); Kazuhisa Mishiro, Osaka (JP); Ryota Onishi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 1136 days.

(21) Appl. No.: 13/824,414

(22) PCT Filed: Sep. 2, 2011

(86) PCT No.: PCT/JP2011/070014
§ 371 (c)(1),
(2), (4) Date: Mar. 18, 2013

(87) PCT Pub. No.: WO2012/046528
PCT Pub. Date: Apr. 12, 2012

(65) Prior Publication Data

US 2013/0180269 A1 Jul. 18, 2013

(30) Foreign Application Priority Data

Oct. 5, 2010 (JP) ..... 2010-226099

(51) Int. Cl.
*F25D 21/00* (2006.01)
*F25B 47/02* (2006.01)
(Continued)

(52) U.S. Cl.
CPC ..... *F25D 21/004* (2013.01); *F24F 11/30* (2018.01); *F25B 47/025* (2013.01); *F24F 11/41* (2018.01);
(Continued)

(58) Field of Classification Search
CPC ..... F25D 21/004; F24F 11/0086; F24F 2011/0087; F24F 2011/0089;
(Continued)

(56) References Cited

U.S. PATENT DOCUMENTS 5,257,506 A * 11/1993 DeWolf ..... F25D 21/006 62/155
5,689,964 A * 11/1997 Kawakita et al. ..... 62/151
(Continued)

FOREIGN PATENT DOCUMENTS

JP 04-013037 * 1/1992 ..... F24F 11/02
JP 04-013037 A 1/1992
(Continued)

OTHER PUBLICATIONS

Official Communication issued in International Patent Application No. PCT/JP2011/070014, dated Nov. 22, 2011.

*Primary Examiner* — Emmanuel Duke
(74) *Attorney, Agent, or Firm* — Keating & Bennett, LLP

(57) ABSTRACT

An air conditioner includes a compressor; an outdoor heat exchanger; an indoor heat exchanger; an outdoor fan configured to supply outdoor air to the outdoor heat exchanger; and an indoor fan configured to supply indoor air to the indoor heat exchanger. The air conditioner performs a heating operation by driving both the indoor fan and the outdoor fan and by causing refrigerant to flow in one direction through both the indoor heat exchanger and the outdoor heat exchanger and so that a defrost operation in which both the indoor fan and the outdoor fan are stopped is performed by causing the refrigerant to flow in the opposite direction to that in the heating operation. When a defrost failure is caused by the defrost operation the outdoor fan is driven, and the indoor fan is stopped for a predetermined period of time, after which the defrost operation is resumed.

18 Claims, 2 Drawing Sheets

(51) Int. Cl.
*F24F 11/30* (2018.01)
*F24F 11/41* (2018.01)
*F24F 11/42* (2018.01)

(52) U.S. Cl.
CPC ..... *F24F 11/42* (2018.01); *F25B 2313/0293* (2013.01); *F25B 2313/0294* (2013.01); *F25B 2313/0314* (2013.01); *F25B 2313/0315* (2013.01); *F25B 2700/21152* (2013.01)

(58) Field of Classification Search
CPC ..... F25B 2700/2115; F25B 2313/0315; F25B 2313/0314; F25B 2313/0293; F25B 2313/0294
USPC ..... 62/81, 156, 335
See application file for complete search history.

(56) References Cited

U.S. PATENT DOCUMENTS 5,904,047 A * 5/1999 An ..... F24F 3/065 62/81
5,927,083 A * 7/1999 Guo ..... F25D 21/006 62/155
6,318,095 B1 * 11/2001 Guo ..... F25B 47/025 62/156
2004/0003604 A1 * 1/2004 So ..... F25B 13/00 62/156
2005/0257558 A1 * 11/2005 Yoshioka ..... B82Y 30/00 62/324.5

FOREIGN PATENT DOCUMENTS

JP 04-194539 A 7/1992
JP 07-120121 A 5/1995
JP 2002-081713 A 3/2002
JP 2003-194438 A 7/2003
JP 2007-155245 A 6/2007
JP WO 2010032430 A1 * 3/2010 ..... F24F 11/0086
JP 2010-181036 A 8/2010
WO WO 2010032430 A1 * 3/2010 ..... F24F 11/0086

* cited by examiner

AIR CONDITIONER AND METHOD FOR CONTROLLING THE AIR CONDITIONER

TECHNICAL FIELD

The present invention relates to an air conditioner that performs a warming operation and a defrosting operation.

BACKGROUND ART

A conventional air conditioner is disclosed in a patent document 1. This air conditioner includes an indoor apparatus disposed indoors and an outdoor apparatus disposed outdoors. The outdoor apparatus is provided with a compressor, an outdoor heat exchanger, and an outdoor fan, while the indoor apparatus is provided with an indoor heat exchanger and an indoor fan. The compressor flows a refrigerant to operate a refrigeration cycle.

A refrigerant outlet portion of the compressor is connected to one end of the indoor heat exchanger and one end of the outdoor heat exchanger via a four-way valve by means of a refrigerant pipe. The other ends of the indoor heat exchanger and outdoor heat exchanger are connected to each other via an expansion valve by means of the refrigerant pipe. The outdoor fan is disposed to oppose the outdoor heat exchanger and prompts a heat exchange between the outdoor heat exchanger and outdoor air. The indoor fan introduces indoor air into the indoor apparatus and sends the air, performing the heat exchange with the indoor heat exchanger, into a room.

During a warming operation time, the refrigerant output from the compressor thanks to switching of the four-way valve flows through the indoor heat exchanger, the expansion valve, the outdoor heat exchanger and returns to the compressor. In this way, the indoor heat exchanger forms a high temperature portion of the refrigeration cycle, while the outdoor heat exchanger forms a low temperature portion of the refrigeration cycle. The indoor air rises in temperature thanks to the heat exchange with the indoor heat exchanger and is sent into the room, whereby the indoor warming is performed. During this time, the indoor heat exchanger performs the heat exchange with the indoor air; as a result of this, the indoor heat exchanger becomes low in temperature, while the outdoor heat exchanger performs the heat exchange with outdoor air to be raised in temperature thanks to driving of the outdoor fan.

During a cooling operation time, the refrigerant output from the compressor thanks to the switching of the four-way valve flows in a direction opposite to the direction during the warming operation time. In other words, the refrigerant flows through the outdoor heat exchanger, the expansion valve, the indoor heat exchanger and returns to the compressor. In this way, the outdoor heat exchanger forms the high temperature portion of the refrigeration cycle, while the indoor heat exchanger forms a low temperature portion of the refrigeration cycle. The indoor air falls in temperature thanks to the heat exchange with the indoor heat exchanger and is sent into the room, whereby the indoor cooling is performed. During this time, the indoor heat exchanger performs the heat exchange with the indoor air; as a result of this, the indoor heat exchanger becomes rises in temperature, while the outdoor heat exchanger performs the heat exchange with outdoor air to be lowered in temperature thanks to driving of the outdoor fan.

Besides, if the outdoor heat exchanger has frost during the warming operation time, a defrosting operation is performed. During a defrosting operation time, the indoor fan and the outdoor fan are stopped, and the refrigerant flows in the same direction as the direction during the cooling operation time thanks to the switching of the four-way valve. In this way, the outdoor heat exchanger forms a high temperature portion of the refrigeration cycle, accordingly, it is possible to defrost the outdoor heat exchanger.

CITATION LIST

Patent Literature

PLT1: JP-A-2010-181036 (pages 4 to 6, FIG. 1)

SUMMARY OF INVENTION

Technical Problem

However, according to the above conventional air conditioner, in a cold area and the like, if it goes down to an extremely low temperature outdoors in a place where the outdoor heat exchanger is installed, a high-temperature refrigerant output from the compressor during a defrosting operation time is deprived of heat by outdoor air, whereby a temperature rise of the outdoor heat exchanger is prevented. Especially, in a situation where a strong wind blows outdoors, the outdoor fan is rotated by the strong wind, whereby the temperature rise of the outdoor heat exchanger is further prevented.

Because of this, even if the defrosting operation is performed for a predetermined time, the outdoor heat exchanger does not rise to a desired temperature, accordingly, defective defrosting occurs, in which frost remains. According to this, the defrosting operation is performed repeatedly during a short time and the defective defrosting is repeated, accordingly, there is a problem that the indoor warming is not performed and convenience of the air conditioner deteriorates. Besides, because of the defective defrosting, the frost remaining on the outdoor heat exchanger grows and the outdoor apparatus is covered by ice to cause the outdoor apparatus to malfunction, whereby there is also a problem that the air conditioner is undermined in reliability.

It is an object of the present invention to provide an air conditioner that is able to reduce defective defrosting and improve the convenience and reliability.

Solution to Problem

To achieve the above object, the present invention is characterized to include: a compressor that operates a refrigeration cycle; an outdoor heat exchanger that is disposed outdoors; an indoor heat exchanger that is disposed indoors; an outdoor fan that supplies outdoor air to the outdoor heat exchanger; and an indoor fan that supplies indoor air to the indoor heat exchanger, wherein the indoor fan and the outdoor fan are driven and a refrigerant is flowed by the compressor in a direction through the indoor heat exchanger and the outdoor heat exchanger so as to perform a warming operation; in a case where the outdoor heat exchanger has frost, the indoor fan and the outdoor fan are stopped, and the refrigerant is flowed in a direction opposite to the warming operation so as to perform a defrosting operation; and in a case of defective defrosting by the defrosting operation, the outdoor fan is driven, the indoor fan is stopped and the refrigerant is flowed in a same direction as the warming operation so as to perform a defrosting preparation operation for a predetermined period, thereafter, the defrosting operation is resumed.

According to this structure, during the warming operation, the indoor fan and the outdoor fan are driven, the refrigerant output from the compressor flows in an order of the indoor heat exchanger to the outdoor heat exchanger and returns to the compressor. In this way, the indoor heat exchanger forms a high-temperature portion of the refrigeration cycle, while the outdoor heat exchanger forms a low-temperature portion of the refrigeration cycle. The indoor air is raised in temperature thanks to the heat exchange with the indoor heat exchanger and sent out into the room, whereby the indoor warming is performed.

If the outdoor heat exchanger has frost, a defrosting operation is performed. During the defrosting operation time, the indoor fan and the outdoor fan are stopped, the refrigerant output from the compressor flows in an order of the outdoor heat exchanger to the indoor heat exchanger and returns to the compressor. In this way, the outdoor heat exchanger forms a high-temperature portion of the refrigeration cycle, while the indoor heat exchanger forms a low-temperature portion of the refrigeration cycle, whereby the outdoor heat exchanger is raised in temperature. If the defrosting operation is performed for a predetermined period and the outdoor heat exchanger is raised to a desired temperature, the defrosting operation is ended and switched to the warming operation.

If the defrosting operation is performed for the predetermined period and the outdoor heat exchanger is not sufficiently raised in temperature to end up with defective defrosting, a defrosting preparation operation is performed. During the defrosting preparation operation, the outdoor fan is driven and the indoor fan is stopped, and the refrigerant output from the compressor flows in the order of the indoor heat exchanger to the outdoor heat exchanger and returns to the compressor in the same way as the warming operation time. In this way, the temperature of the refrigerant flowing in the refrigeration cycle rises. And, the defrosting operation is resumed, whereby the refrigerant raised in temperature by the defrosting preparation operation flows in the refrigeration cycle and the outdoor heat exchanger is defrosted.

Besides, in the air conditioner having the above structure, the present invention is characterized in that the warming operation is performed for a predetermined period before the defrosting preparation operation. According to this structure, if the defrosting operation ends up with the defective defrosting, the defrosting preparation operation is performed after the warming operation is performed for a predetermined period. In this way, it is possible to prevent an indoor temperature decline.

Besides, in the air conditioner having the above structure, the present invention is characterized in that in a case where a predetermined time span passes after the defrosting preparation operation is started, or in a case where temperature of the indoor heat exchanger rises higher than a predetermined temperature during the defrosting preparation operation time, the defrosting operation is resumed.

Besides, in the air conditioner having the above structure, the present invention is characterized in that in a case where temperature of the outdoor heat exchanger does not rise higher than a predetermined temperature even if a predetermined time span passes after the defrosting operation is started, or in a case where a temperature of the refrigerant output from the compressor declines below a predetermined temperature during the defrosting operation, it is determined to be the defective defrosting.

Advantageous Effects of Invention

According to the present invention, during the defective defrosting time, the refrigerant is flowed in the same direction as the warming operation; the outdoor fan is driven; the defrosting preparation operation is performed for the predetermined period with the indoor fan stopped, thereafter, the defrosting operation is resumed, accordingly, the refrigerant raised in temperature by the defrosting preparation operation is made to flow and the defrosting operation is resumed. In this way, the defective defrosting at the resumption of the defrosting operation is reduced, and it is possible to move to the warming operation as soon as possible, perform the indoor warming and prevent malfunction of the outdoor apparatus. Accordingly, it is possible to improve the convenience and reliability of the air conditioner.

DESCRIPTION OF EMBODIMENTS

Figure 1:
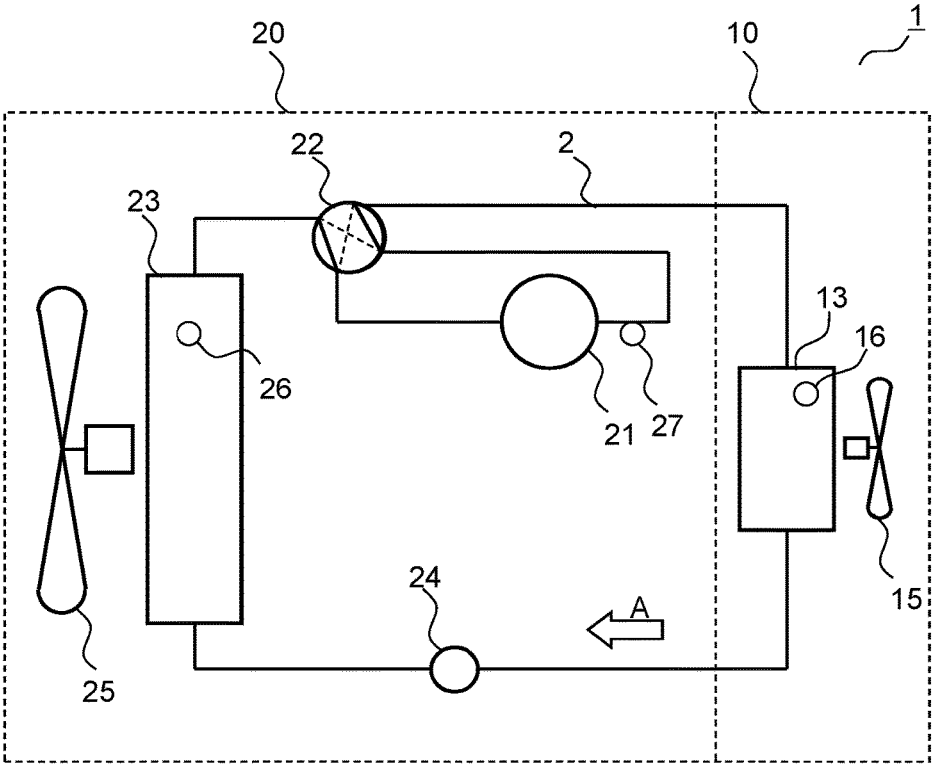
[FIG. 1] is a circuit diagram showing a refrigeration cycle of an air conditioner according to an embodiment of the present invention.

Hereinafter, an embodiment of the present invention is described with reference to the drawings. FIG. 1 is a circuit diagram showing a refrigeration cycle of an air conditioner according to an embodiment. An air conditioner 1 has an indoor apparatus 10 disposed indoors and an outdoor apparatus 20 disposed outdoors. In the air conditioner 1, a compressor 21, which flows a refrigerant in a refrigerant pipe 2 and operates the refrigeration cycle, is disposed in the outdoor apparatus 20.

The outdoor apparatus 20 is provided therein with: a four-way valve 22 connected to the compressor 21; an outdoor heat exchanger 23; an expansion valve 24; and an outdoor fan 25. The indoor apparatus 10 is provided therein with: an indoor heat exchanger 13; and an indoor fan 15. The compressor 21 is connected to one end of the outdoor heat exchanger 23 and one end of the indoor heat exchanger 13 via the four-way valve 22 by means of the refrigerant pipe 2. The other ends of the outdoor heat exchanger 23 and indoor heat exchanger 13 are connected to each other via the expansion valve 24 by means of the refrigerant pipe 2.

The outdoor fan 25 is disposed to oppose the outdoor heat exchanger 23. By driving the outdoor fan 25, outdoor air is supplied to the outdoor heat exchanger 23, whereby a heat exchange between the outdoor heat exchanger 23 and the outdoor air is prompted. The air performing the heat exchange with the outdoor heat exchanger 23 is exhaled to outside via an air outlet (not shown) that faces the outdoor fan 25 and opens from the outdoor apparatus 20.

The indoor fan 15 and the indoor heat exchanger 13 are disposed in an airflow path (not shown) formed in the indoor apparatus 10. By driving the indoor fan 15, indoor air flows into the airflow path to be supplied to the indoor heat exchanger 13, whereby a heat exchange is performed between the air flowing in the airflow path and the indoor heat exchanger 13. The air performing the heat exchange with the indoor heat exchanger 13 is sent into the room via an air output opening (not shown) that opens from the indoor apparatus 10.

The outdoor heat exchanger 23 is provided with an outdoor heat exchanger temperature sensor 26 that detects temperature of the outdoor heat exchanger 23. Besides, the refrigerant pipe 2 at an output side of the compressor 21 is provided with an output temperature sensor 27 that detects an output temperature of the refrigerant. The indoor heat exchanger 13 is provided with an indoor heat exchanger temperature sensor 16 that detects temperature of the indoor heat exchanger 13.

During a warming operation time, the indoor fan 15 and the outdoor fan 25 are driven and the four-way valve 22 is switched as shown by a solid line in the figure. In this way, by driving the compressor 21, the refrigerant flows in a direction indicated by an arrow A, and the refrigerant, which is compressed by the compressor 21 to have a high temperature and high pressure, radiates heat in the indoor heat exchanger 13 and condenses.

The high-temperature refrigerant is expanded by the expansion valve 24 to have a low temperature and low pressure, and sent to the outdoor heat exchanger 23. The refrigerant flowing into the outdoor heat exchanger 23 absorbs heat and evaporates to turn into a low-temperature gas refrigerant and is sent to the compressor 21. In this way, the refrigerant circulates and the refrigeration cycle is operated. The air, performing the heat exchange with the indoor heat exchanger 13 that forms a high-temperature portion of the refrigeration cycle, is sent out into the room by the indoor fan 15, whereby the indoor warming is performed. Besides, the air, performing the heat exchange with the outdoor heat exchanger 23 that form a low-temperature portion of the refrigeration cycle, is exhaled to outside by the outdoor fan 25.

During a cooling operation time, the indoor fan 15 and the outdoor fan 25 are driven and the four-way valve 22 is switched as shown by a broken line in the figure. In this way, by driving the compressor 21, the refrigerant flows in a direction opposite to the arrow A direction, whereby the indoor heat exchanger 13 forms a low-temperature portion of the refrigeration cycle, while the outdoor heat exchanger 23 forms a high-temperature portion of the refrigeration cycle. The air, performing the heat exchange with the indoor heat exchanger 13, is sent into the room by the indoor fan 15, whereby the indoor cooling is performed. Besides, the air, performing the heat exchange with the outdoor heat exchanger 23 which forms a high temperature portion of the refrigeration cycle, is exhaled to outside by the outdoor fan 25.

Figure 2:
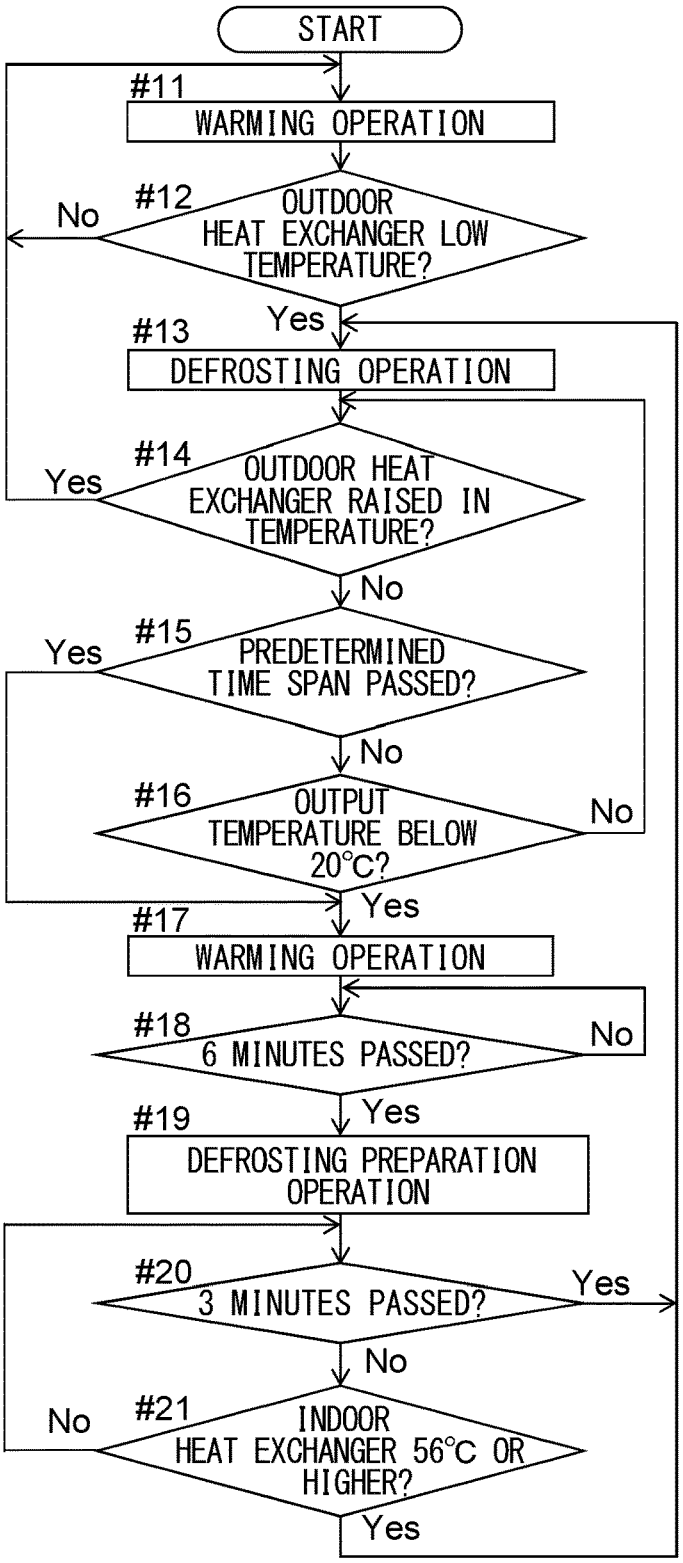
[FIG. 2] is a flow chart showing operation during a warming operation time of an air conditioner according to an embodiment of the present invention.

FIG. 2 is a flow chart showing detailed operation during the warming operation time of the air conditioner 1. If an instruction for starting the warming operation is issued, in a step #11, the indoor fan 15, the outdoor fan 25 and the compressor 21 are driven to perform the warming operation. In this way, the refrigerant flows in the arrow A direction. In a step #12, based on detection by the outdoor heat exchanger temperature sensor 26, it is determined whether the outdoor heat exchanger 23 has a temperature lower than a predetermined temperature because of frost or not.

In a case where the outdoor heat exchanger 23 does not have a temperature lower than the predetermined temperature, back to the step #11, and the steps #11 and #12 are repeated. If the outdoor heat exchanger 23 has a temperature lower than the predetermined temperature, in a step #13, a defrosting operation is performed.

During the defrosting operation, the indoor fan 15 and the outdoor fan 25 are stopped, and the four-way valve 22 is switched as shown by a broken line in FIG. 1. In this way, the refrigerant flows in the direction opposite to the arrow A direction, whereby the outdoor heat exchanger 23 forms the high-temperature portion of the refrigeration cycle to be raised in temperature. During this time, thanks to the stopping of the outdoor fan 25, the heat exchange between the outdoor heat exchanger 23 and outdoor air is prevented, whereby it is possible to efficiently raise the temperature of the outdoor heat exchanger 23. Besides, thanks to the stopping of the indoor fan 15, it is possible to prevent low-temperature air from being sent out into the room.

In a step #14, based on the detection by the outdoor heat exchanger temperature sensor 26, it is determined whether the outdoor heat exchanger 23 is raised to a temperature higher than the predetermined temperature or not. In a case where the outdoor heat exchanger 23 is not raised to a temperature higher than the predetermined temperature, the process moves to a step #15. In the step #15, it is determined whether a predetermined time span passes after the defrosting operation is started or not. In a case where the predetermined time span passes after the defrosting operation is started, it is determined to be defective defrosting, and the process moves to a step #17. In a case where the predetermined time span does not pass after the defrosting operation is started, the process moves to a step #16.

In the step #16, based on detection by the output temperature sensor 27, it is determined whether the output temperature of the refrigerant declines below a predetermined temperature (20° C. in the present embodiment) or not. In a case where the output temperature of the refrigerant declines below the predetermined temperature, it is determined to be the defective defrosting, and the process moves to the step #17. In a case where the output temperature of the refrigerant does not decline below the predetermined temperature, back to the step #14, and the steps #14 to #16 are repeated. And, in the step #14, in a case where the outdoor heat exchanger 23 is raised to a temperature higher than the predetermined temperature, it is determined that the defrosting is completed, back to the step #11, and the steps #11 to #14 are repeated.

If it is determined to be the defective defrosting in the step #15 and the step #16, the defrosting operation is ended and the warming operation is performed in the step #17. In a step #18, the process waits until the warming operation started in the step #17 is performed for a predetermined time span (6 minutes in the present embodiment). During the defective defrosting, the outdoor heat exchanger 23 is prevented to be raised in temperature by outdoor low-temperature air, whereby temperature of the refrigerant flowing in the refrigeration cycle declines. Because of this, it is possible to raise the temperature of the refrigerant flowing in the refrigeration cycle by means of the warming operation. Besides, by performing the warming operation for the predetermined time after the defrosting operation, it is possible to prevent an indoor temperature decline.

If the warming operation is performed for the predetermined time span, the process moves to a step #19, and a defrosting preparation operation is performed. During the defrosting preparation operation, the indoor fan 15 is stopped from the state of the warming operation. Specifically, the four-way valve 22 is switched as shown by the solid line in FIG. 1, the compressor 21 and the outdoor fan 25 are driven, and the indoor fan 15 is stopped. In this way, the refrigerant flows in the same direction (arrow A direction) as the warming operation, and the temperature raising of the refrigerant is continuously performed. During this time, by stopping the indoor fan 15, it is possible to prevent the heat exchange between the indoor air and the indoor heat exchanger 13 that is the high-temperature portion of the refrigeration cycle and to raise the temperature of the refrigerant higher than during the warming operation time.

In a step #20, it is determined whether a predetermined time span (3 minutes in the present embodiment) passes after the defrosting preparation operation is started or not. In a case where the predetermined time span does not pass after the defrosting preparation operation is started, the process moves to a step #21. In the step #21, it is determined based on detection by the indoor heat exchanger temperature sensor 16 whether the indoor heat exchanger 13 is raised to a temperature higher than a predetermined temperature (56° C. or higher in the present embodiment) or not. In a case where the indoor heat exchanger 13 is not raised to a temperature higher than the predetermined temperature, the steps #20 and #21 are repeatedly performed.

In a case where it is determined in the step #20 that the predetermined time span passes after the defrosting preparation operation is started, or in a case where it is determined in the step #21 that the indoor heat exchanger 13 is raised to a temperature higher than the predetermined temperature, back to the step #13, and the defrosting operation is resumed. In this way, the refrigerant, which is raised in temperature by the warming operation in the step #17 and by the defrosting preparation operation in the step #19, flows to perform the defrosting operation again. Accordingly, it is possible to surely remove the frost on the outdoor heat exchanger 23 by means of the resumed defrosting operation and to reduce the defective defrosting.

In the meantime, setting the temperature of the indoor heat exchanger 13, which is used to determine the end of the defrosting preparation operation in the step #21, at 56° C., the pressure in a case where the R410A is used as the refrigerant is equivalent to 3.5 MPa-abs. Because of this, considering a time lag from the detection of the temperature rise of the indoor heat exchanger 13 to the switching to the defrosting operation and a detection error of the indoor heat exchanger temperature sensor 16, it is a safe pressure within the specification range.

Besides, it is also conceivable to use the output temperature from the compressor 21 as a criterion for determining the temperature rise of the indoor heat exchanger 13. However, it is very hard to predict the pressure based on the output temperature, and the pressure is likely to exceed the specification range. Accordingly, in the present embodiment, the detected temperature by the indoor heat exchanger temperature sensor 16 is used.

According to the present embodiment, at the defective defrosting, the refrigerant is flowed in the same direction (arrow A direction) as the warming operation and the outdoor fan 25 is driven to perform the defrosting preparation operation for the predetermined period with the indoor fan 15 stopped, thereafter, the defrosting operation is resumed, accordingly, the refrigerant raised in temperature by the defrosting preparation operation is flowed to resume the defrosting operation. In this way, the defective defrosting at the resumption time of the defrosting operation is reduced, and it is possible to move to the warming operation as soon as possible so as to perform the indoor warming and to prevent the malfunction of the outdoor apparatus 20 caused by the frost growth. Accordingly, it is possible to improve the convenience and reliability of the air conditioner 1.

Besides, the warming operation is performed for the predetermined period in the step #17 before the defrosting preparation operation, accordingly, it is possible to prevent the indoor temperature decline. In the meantime, the steps #17 and #18 may be skipped to immediately perform the defrosting preparation operation at the defective defrosting time. In this way, it is possible to raise the refrigerant temperature more rapidly and to rapidly resume the defrosting operation.

Besides, the process moves to the step #13 in the case (step #20) where the predetermined time span passes after the defrosting preparation operation is started, accordingly, it is possible to perform the defrosting preparation operation until the refrigerant is sufficiently raised in temperature, thereafter, to resume the defrosting operation.

Besides, the process moves to the step #13 in the case (step #21) where the temperature of the indoor heat exchanger 13 rises to a temperature higher than the predetermined temperature during the defrosting preparation operation, accordingly, it is possible to rapidly resume the defrosting operation.

Besides, in the case (step #15) where the temperature of the outdoor heat exchanger 23 does not rise to a temperature higher than the predetermined temperature even if the predetermined time span passes after the defrosting operation is started, or in the case (step #16) where the output temperature of the refrigerant from the compressor 21 during the defrosting operation declines below the predetermined temperature, it is determined to be the defective defrosting, accordingly, it is possible to easily determine the defective defrosting and end the defrosting operation.

INDUSTRIAL APPLICABILITY

The present invention is usable for air conditioners that perform a warming operation and a defrosting operation.

REFERENCE SIGNS LIST

1 air conditioner
2 refrigerant pipe
10 indoor apparatus
13 indoor heat exchanger
15 indoor fan
16 indoor heat exchanger temperature sensor
20 outdoor apparatus
21 compressor
22 four-way valve
23 outdoor heat exchanger
24 expansion valve
25 outdoor fan
26 outdoor heat exchanger temperature sensor
27 output temperature sensor

The invention claimed is:

1. An air conditioner comprising:
a compressor that operates a refrigeration cycle;
an outdoor heat exchanger that is disposed outdoors;
an indoor heat exchanger that is disposed indoors;
an outdoor fan that supplies outdoor air to the outdoor heat exchanger; and
an indoor fan that supplies indoor air to the indoor heat exchanger, wherein
the indoor fan and the outdoor fan are driven and a refrigerant is flowed by the compressor in a direction through the indoor heat exchanger and the outdoor heat exchanger so as to perform a warming operation;
in a case where the outdoor heat exchanger has frost, the indoor fan and the outdoor fan are stopped, and the refrigerant is flowed in a direction opposite to the direction of the warming operation so as to perform a defrosting operation;
in a case where a temperature of the outdoor heat exchanger rises higher than a first temperature during the defrosting operation, the warming operation is resumed;
in a case where the temperature of the outdoor heat exchanger does not rise above the first temperature and an output temperature of the refrigerant output from the compressor declines below a second temperature during the defrosting operation, existence of defective defrosting is determined;

in a case where the existence of the defective defrosting has been determined, the compressor and the outdoor fan are driven, the indoor fan is stopped and the refrigerant is flowed in the direction of the warming operation so as to perform a defrosting preparation operation, thereafter, the defrosting operation is resumed; and in the case where the temperature of the outdoor heat exchanger rises higher than the first temperature during the defrosting operation, the warming operation is resumed without performing the defrosting preparation operation.

2. The air conditioner according to claim 1, wherein the warming operation is performed for a predetermined period before the defrosting preparation operation.

3. The air conditioner according to claim 2, wherein in a case where a first predetermined time span passes after the defrosting preparation operation is started, or in a case where a temperature of the indoor heat exchanger rises higher than a predetermined temperature during the defrosting preparation operation time, the defrosting operation is resumed.

4. The air conditioner according to claim 2, wherein also in a case where the temperature of the outdoor heat exchanger does not rise higher than the first temperature even if a second predetermined time span passes after the defrosting operation is started, the existence of the defective defrosting is determined.

5. The air conditioner according to claim 1, wherein in a case where a first predetermined time span passes after the defrosting preparation operation is started, or in a case where a temperature of the indoor heat exchanger rises higher than a predetermined temperature during the defrosting preparation operation time, the defrosting operation is resumed.

6. The air conditioner according to claim 1, wherein also in a case where the temperature of the outdoor heat exchanger does not rise higher than the first temperature even if a second predetermined time span passes after the defrosting operation is started, or in a case where a temperature of the refrigerant output from the compressor declines below a predetermined temperature during the defrosting operation, the existence of the defective defrosting is determined.

7. The air conditioner according to claim 1, wherein the defrosting operation is performed, but the warming operation is not performed, during a period from a time when existence of the defective defrosting is determined during the defrosting operation to a time when the defrosting operation is resumed.

8. The air conditioner according to claim 1, further comprising a four-way valve and a refrigerant pipe, wherein the compressor is connected by the refrigerant pipe to one end of the outdoor heat exchanger and one end of the indoor heat exchanger via the four-way valve;

the refrigerant pipe is provided with an output temperature sensor at an output side of the compressor; and the output temperature sensor detects the output temperature at a position between the compressor and the four-way valve.

9. The air conditioner of claim 1, wherein after the defrosting preparation operation, the defrosting operation is resumed without performing the warning operation.

10. A method for controlling an air conditioner that includes:

a compressor that operates a refrigeration cycle;

an outdoor heat exchanger that is disposed outdoors;

an indoor heat exchanger that is disposed indoors;

an outdoor fan that supplies outdoor air to the outdoor heat exchanger; and an indoor fan that supplies indoor air to the indoor heat exchanger, the method comprising:

a step of driving the indoor fan and the outdoor fan and flowing a refrigerant with the compressor in a direction through the indoor heat exchanger and the outdoor heat exchanger so as to perform a warming operation;

a step of stopping the indoor fan and the outdoor fan and flowing the refrigerant in a direction opposite to the warming operation so as to perform a defrosting operation in a case where the outdoor heat exchanger has frost;

a step of resuming the warming operation in a case where a temperature of the outdoor heat exchanger rises higher than a first temperature during the defrosting operation;

a step of determining existence of defective defrosting in a case where the temperature of the outdoor heat exchanger does not rise higher than the first temperature and an output temperature of the refrigerant output from the compressor declines below a second temperature during the defrosting operation;

a step of driving the compressor and the outdoor fan, stopping the indoor fan, and flowing the refrigerant in the direction of the warming operation so as to perform a defrosting preparation operation in a case where the existence of the defective defrosting has been determined; and a step of resuming the defrosting operation after the defrosting preparation operation; wherein in the case where the temperature of the outdoor heat exchanger rises higher than the first temperature during the defrosting operation, the warming operation is resumed without performing the defrosting preparation operation.

11. The method for controlling an air conditioner according to claim 10, wherein the warming operation is performed for a predetermined period before the defrosting preparation operation.

12. The method for controlling an air conditioner according to claim 11, wherein in a case where a first predetermined time span passes after the defrosting preparation operation is started, or in a case where a temperature of the indoor heat exchanger rises higher than a predetermined temperature during the defrosting preparation operation time, the defrosting operation is resumed.

13. The method for controlling an air conditioner according to claim 11, wherein also in a case where the temperature of the outdoor heat exchanger does not rise higher than the first temperature even if a second predetermined time span passes after the defrosting operation is started, the existence of the defective defrosting is determined.

14. The method for controlling an air conditioner according to claim 10, wherein in a case where a first predetermined time span passes after the defrosting preparation operation is started, or in a case where a temperature of the indoor heat exchanger rises higher than a predetermined temperature during the defrosting preparation operation time, the defrosting operation is resumed.

15. The method for controlling an air conditioner according to claim 10, wherein also in a case where the temperature of the outdoor heat exchanger does not rise higher than the first temperature even if a second predetermined time span passes after the defrosting operation is started, the existence of the defective defrosting is determined.

16. The method for controlling an air conditioner according to claim 10, wherein the defrosting operation is performed, but the warming operation is not performed, during a period from a time when existence of the defective defrosting is determined during the defrosting operation to a time when the defrosting operation is resumed.

17. The method for controlling an air conditioner according to claim 10, wherein the air conditioner includes a four-way valve and a refrigerant pipe;

the compressor is connected through the refrigerant pipe to one end of the outdoor heat exchanger and one end of the indoor heat exchanger via a four-way valve;

the refrigerant pipe is provided with an output temperature sensor at an output side of the compressor; and the output temperature sensor detects the output temperature at a position between the compressor and the four-way valve.

18. The method for controlling an air conditioner according to claim 10, wherein after the defrosting preparation operation, the defrosting operation is resumed without performing the warning operation.

* * * * *